US006702042B2

(12) United States Patent
Genevois et al.

(10) Patent No.: US 6,702,042 B2
(45) Date of Patent: Mar. 9, 2004

(54) METHOD AND DEVICE FOR ROTARY WELL DRILLING

(75) Inventors: Jean-Michel Genevois, Verneuil-sur-Seine (FR); Hédi Sellami, Montouge (FR); Christophe Simon, Montreuil (FR)

(73) Assignees: Total Fina Elf S.A., Courbeboie (FR); Association pour la Recherche et le Developpement des Methodes et Processus Industriels, Paris (FR)

( * ) Notice: Subject to any disclaimer, the term of this patent is extended or adjusted under 35 U.S.C. 154(b) by 0 days.

(21) Appl. No.: 10/088,931

(22) PCT Filed: Jul. 25, 2001

(86) PCT No.: PCT/FR01/02427

§ 371 (c)(1),
(2), (4) Date: Jun. 20, 2002

(87) PCT Pub. No.: WO02/08563

PCT Pub. Date: Jan. 31, 2002

(65) Prior Publication Data

US 2002/0170750 A1 Nov. 21, 2002

(30) Foreign Application Priority Data

Jul. 25, 2000 (FR) ..... 00 09721

(51) Int. Cl.[7] ..... E21B 47/02

(52) U.S. Cl. ..... 175/45; 175/61; 175/76; 175/73; 175/45

(58) Field of Search ..... 175/61, 76, 73, 175/45

(56) References Cited

U.S. PATENT DOCUMENTS

| | | | | |
|---|---|---|---|---|
| 4,319,649 | A | * 3/1982 | Jeter | 175/73 |
| 4,606,417 | A | * 8/1986 | Webb et al. | 175/76 |
| 4,807,708 | A | * 2/1989 | Forrest et al. | 175/45 |
| 4,989,679 | A | * 2/1991 | Amaudric du Chaffaut | 175/325.3 |
| 5,168,941 | A | * 12/1992 | Krueger et al. | 175/26 |
| 5,213,168 | A | * 5/1993 | Warren et al. | 175/61 |
| 5,603,386 | A | * 2/1997 | Webster | 175/76 |
| 6,206,108 | B1 | * 3/2001 | MacDonald et al. | 175/24 |
| 6,321,857 | B1 | * 11/2001 | Eddison | 175/61 |

FOREIGN PATENT DOCUMENTS

| | | |
|---|---|---|
| EP | 0806542 | * 11/1997 |
| FR | 2780753 | * 1/2000 |
| WO | WO 00/28188 | * 5/2000 |

* cited by examiner

*Primary Examiner*—Hoang Dang
(74) *Attorney, Agent, or Firm*—Sughrue Mion, PLLC

(57) ABSTRACT

The invention concerns a method which includes the steps of: introducing into a pre-drilled portion of a well (16) a drilling system containing a drilling bit (11) assembled with tubular lining elements (15), an element for measuring the inclination and azimuth direction of the pre-drilled part of the well, an element for rotary friction (26, 27) against the wall of the pre-drilled part and an element capable of modifying the friction coefficient of the friction element against the wall; measuring the azimuth direction of the pre-drilled part of the well (16); and varying the friction coefficient of the friction element (26, 27) sufficiently to influence the azimuth direction of the next well portion to be drilled.

7 Claims, 12 Drawing Sheets

METHOD AND DEVICE FOR ROTARY WELL DRILLING

This invention relates to a method for rotary well drilling that makes it possible to actively control both the inclination and the azimuth path of the well when drilling. The invention also relates to a device for implementing said method.

The techniques that aim at controlling the direction of the drilled well's path, when drilling a well, have known spectacular progress with the advent of measurements at the bottom of the hole during the drilling (techniques called MWD, from "Measurement While Drilling"). The inclination and azimuth orientation of the drilling can thus easily be followed and controlled, using both traditional deflection systems, such as the downhole motor hooked up to a bent sub (called "motor and bent-sub") or, more recently, the downhole motor with built-in sub (called "bent-housing").

Said downhole motor drilling systems, and mainly the last one mentioned above, which is widely used today, have taken on a more and more important role among the array of directional tools being used in modem directional drilling operations. Over the last few years, they even had a tendency to supersede the directional tools that use the traditional rotary drilling principle.

However, downhole motor drilling does have a certain number of disadvantages.

The principle is linked to the fact that, in order to make corrections to the path, it is necessary to keep rotating the stopped string, so as to be able to point the downhole motor bend in a defined direction in a fixed plane. Stopping the rotation of the string leads to a significant increase in the friction of the drill string inside the well which has a negative effect on, among other things, the correct transmission of the weight over the drill bit needed for the drilling to progress properly. Therefore, the speed of penetration is reduced, as is the possible length of the drilling passes, whether it be in traditional deviated wells, highly deviated wells or horizontal drains. In some cases, stopping the rotation can also make the rods stick against the wall of the hole, through a differential pressure effect, which hinders the continuation of the drilling.

Other techniques, currently developed, aim at implementing systems that make it possible to control the inclination and azimuth orientation of the drilling, while maintaining the rotation of the drill string from the surface, which is the underlying principle of the traditional rotary drilling. The most evolved (and the most complex) systems called RSS, "Rotary Stecrable System", make it possible to generate a substantially lateral force against the drill bit, using pistons that rest on the wall of the well (technique called "Push The Bit") or to slightly pivot the drill bit in any direction, by bending the drill shaft upstream from the drill bit. The complexity of said systems is linked to the activation mechanism, as well as to the device that controls and commands the orientation of the action.

At the same time, the development of the directional behavior codes of the string in traditional rotary drilling, using stabilized rotary strings, has made it possible to highlight the influence of a certain number of parameters linked to the geometry and the mechanical characteristics of the string, that have a significant influence on the directional answer of the drilling system.

Indeed, if the well has a significant inclination, the string, under the effect of gravity, rests on the lower part of the hole. It takes on a deformed profile (abbreviated as "distortion"), that can be controlled by varying the resting points, meaning by acting on the position and the diameter of the stabilizers, whose role is to more or less center the drill collars in the hole. For a specific distortion of the string, we know the orientation of the lateral force the drill bit, which is, to simplify matters, either pointed upward, or pointed downward, from the direction of gravity. Experience has shown that any traditional rotary string that transmits a lateral force with a large enough module and directed upward to the drill bit will develop, in a consolidated formation, a tendency called "upward" (also called "build-up tendency"), whose final effect will be an increase in the inclination of the well as the drilling is carried out. Conversely, any traditional rotary string that transmits a lateral force directed downward and with a rather large module to the drill bit will develop, in a consolidated formation, a tendency called "falling" (also called "drop-off tendency), whose final effect will be a reduction of the inclination of the well as the drilling is carried out.

A third behavior can be added to these two and relates to the use of rotary drilling strings in straight sections (called "slant sections), that still today make up a large portion of the drilled lengths in modem deviated wells. Indeed, experience has also shown that any traditional rotary string subjected to a force that is lateral to the drill bit, directed either upward or downward, and with a low module (or even a non existent module) develops, in a consolidated formation, a tendency called "neutral" (also called "lock-up tendency"), whose final effect is to maintain the inclination of the well as the drilling is carried out.

This is illustrated in FIGS. 1*a,* 1*b,* 2*a* and 2*b* from the set of attached schematic drawings, of which the other figures will be explained in further detail later, while referring to the description of this invention. To make things easier, in said figures the drill strings are represented horizontally, which is only one specific configuration of the inclination.

More precisely:

FIG. 1*a* illustrates an example of the configuration of the traditional rotary string called "build-up tendency";

FIG. 1*b* illustrates an example of the configuration of the traditional rotary string called "drop-off tendency";

FIGS. 2*a* and 2*b* illustrate the control of the inclination of a drill hole using a stabilizer with a variable diameter;

FIG. 3*a* is a cut away perspective view that illustrates the incidence of friction of a stabilizer whose diameter is less than that of a well against the wall of the latter and the role of the bit on the orientation of the drilling direction outside the vertical plane;

FIG. 3*b* is a cut according to the transversal plane 22 of FIG. 3*a;*

FIG. 4*a* is a view similar to that of figure 3*a* of the drilling device as set forth in the invention, with the stabilizer in the engaged mode, meaning with the blade block linked in rotation to the string;

FIG. 4*b* is a cut according to the transversal plane 22 of FIG. 4*a;*

FIGS. 5*a* and 5*b* are views that are respectively similar to FIGS. 4*a* and 4*b* with the stabilizer in the disengaged mode, meaning with the blade block in free rotation in relation to the drill lining;

Figure 9A:
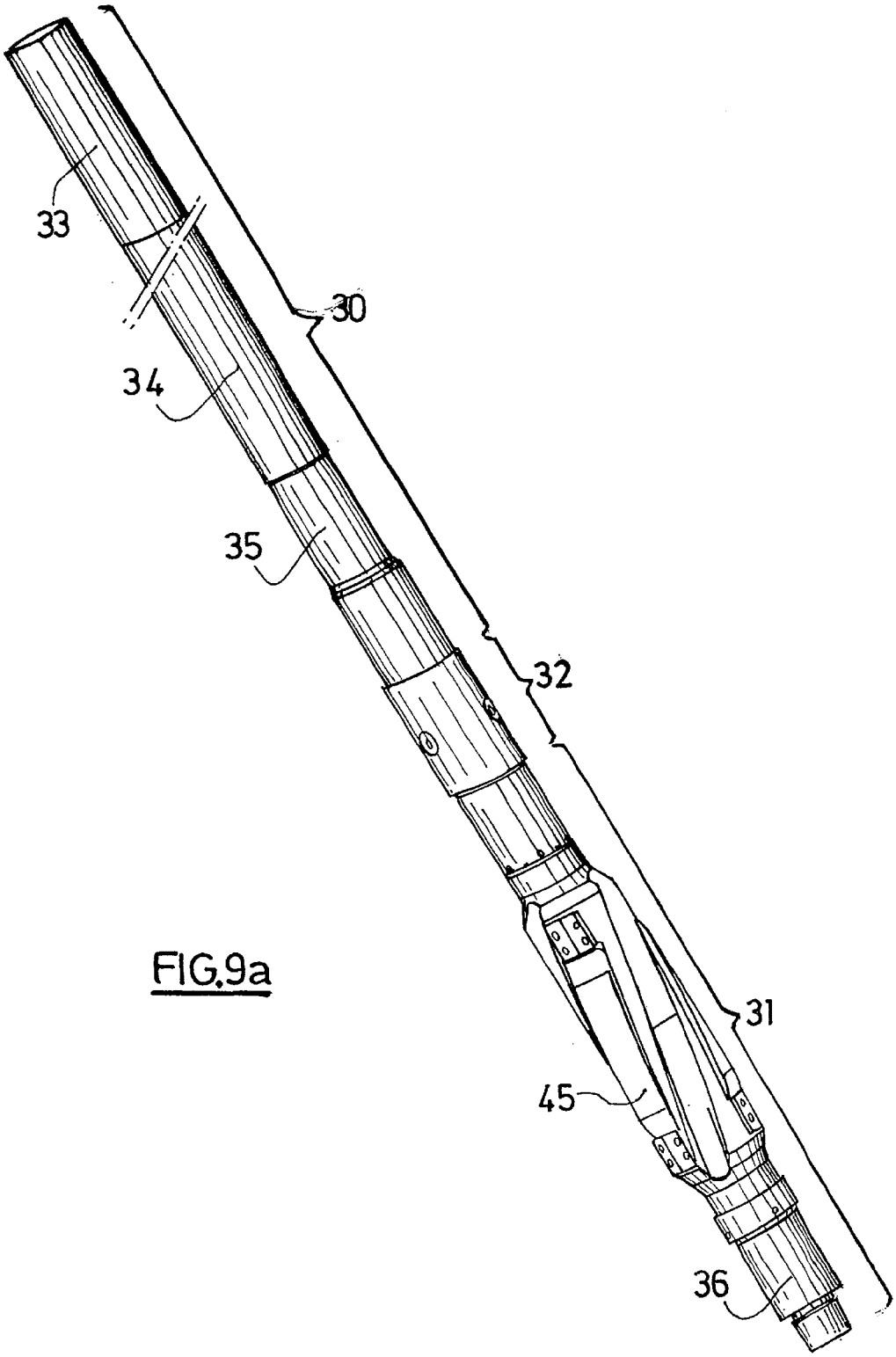
Figure 9B:
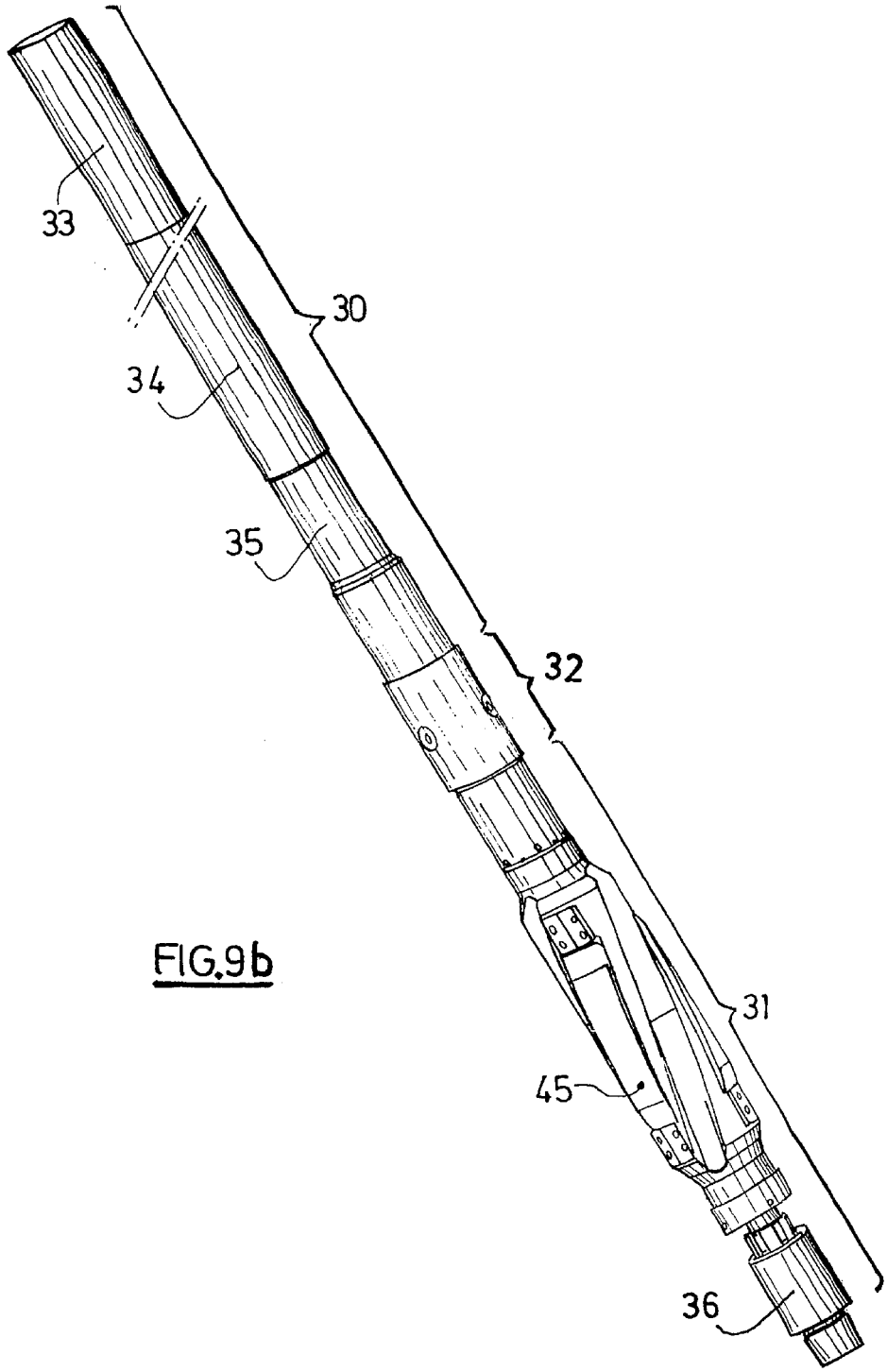
Figure 10:
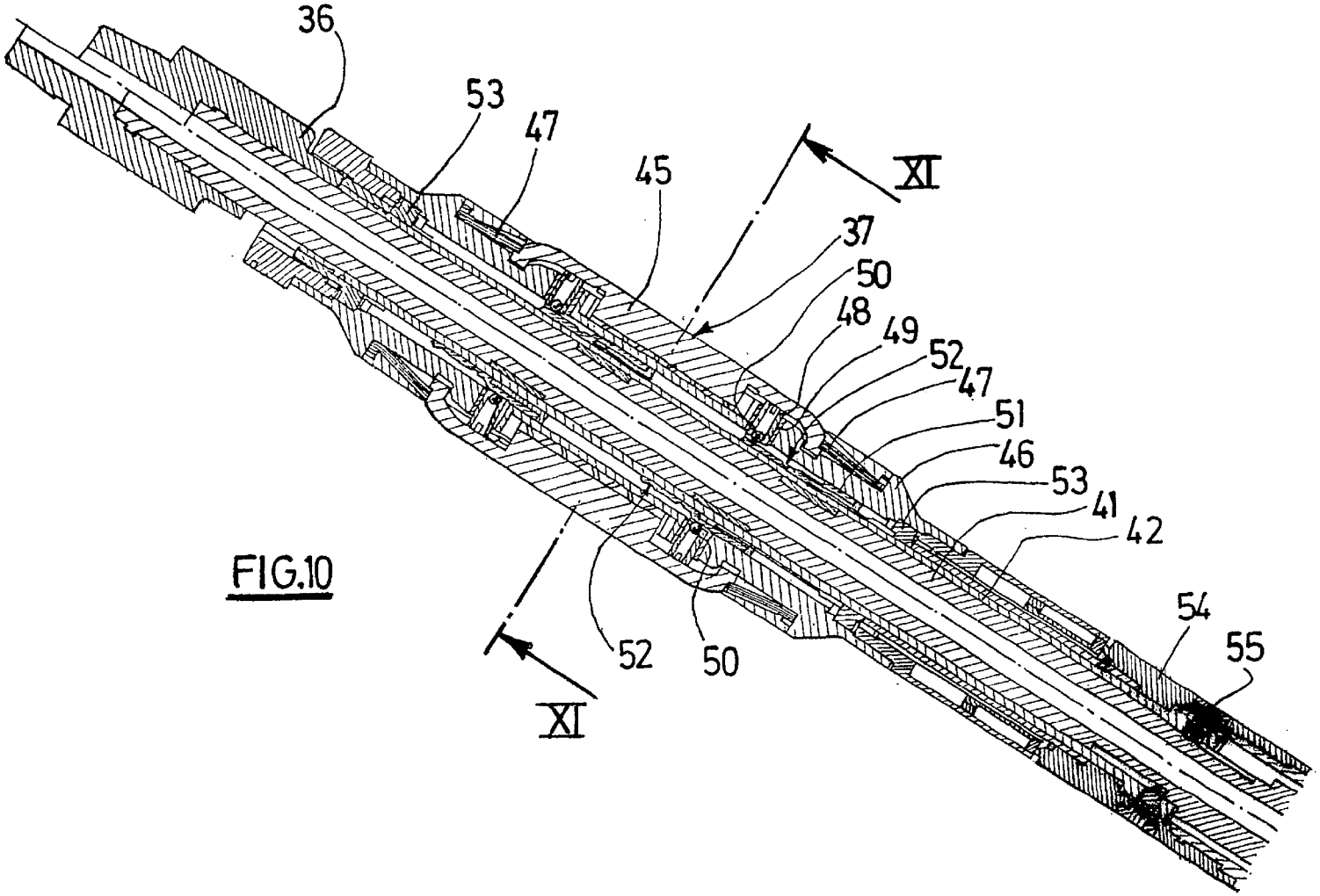
Figure 11:
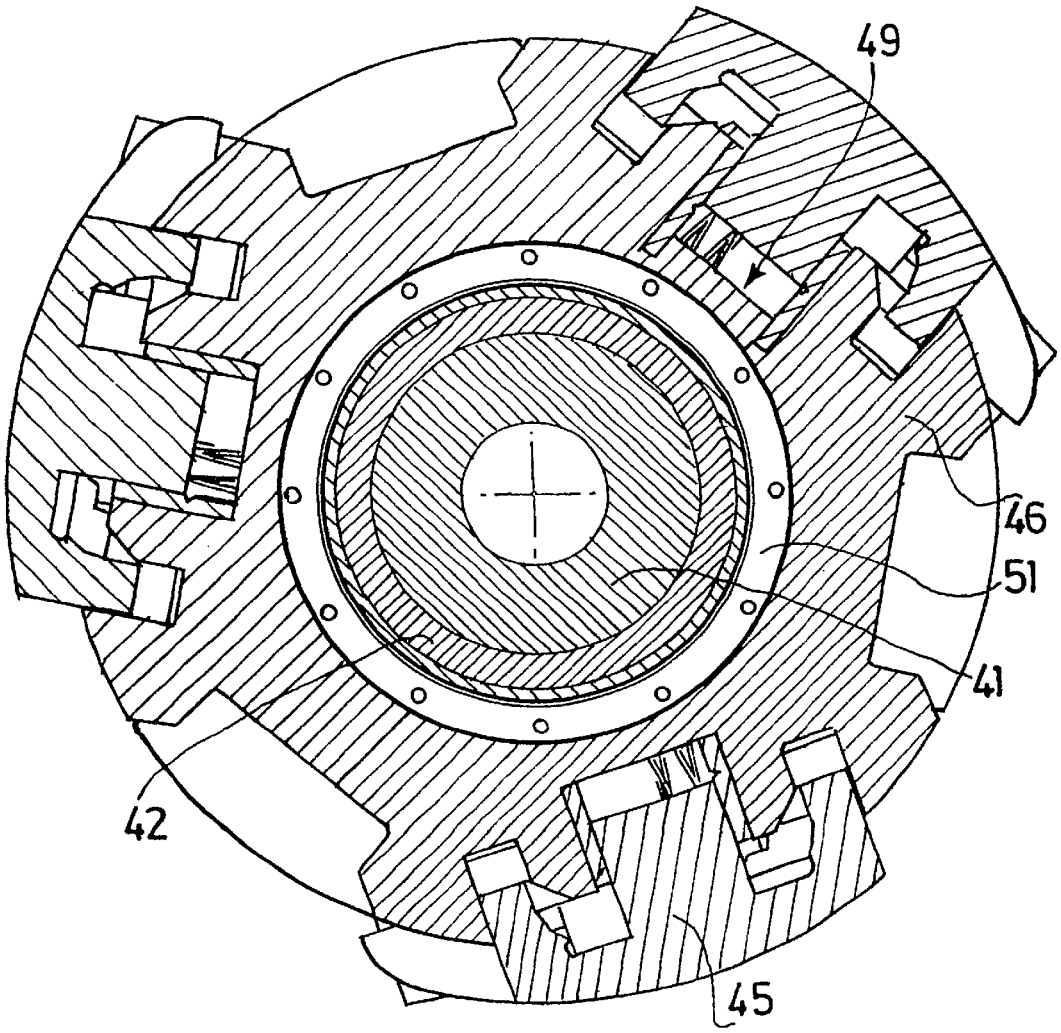
Figure 12:
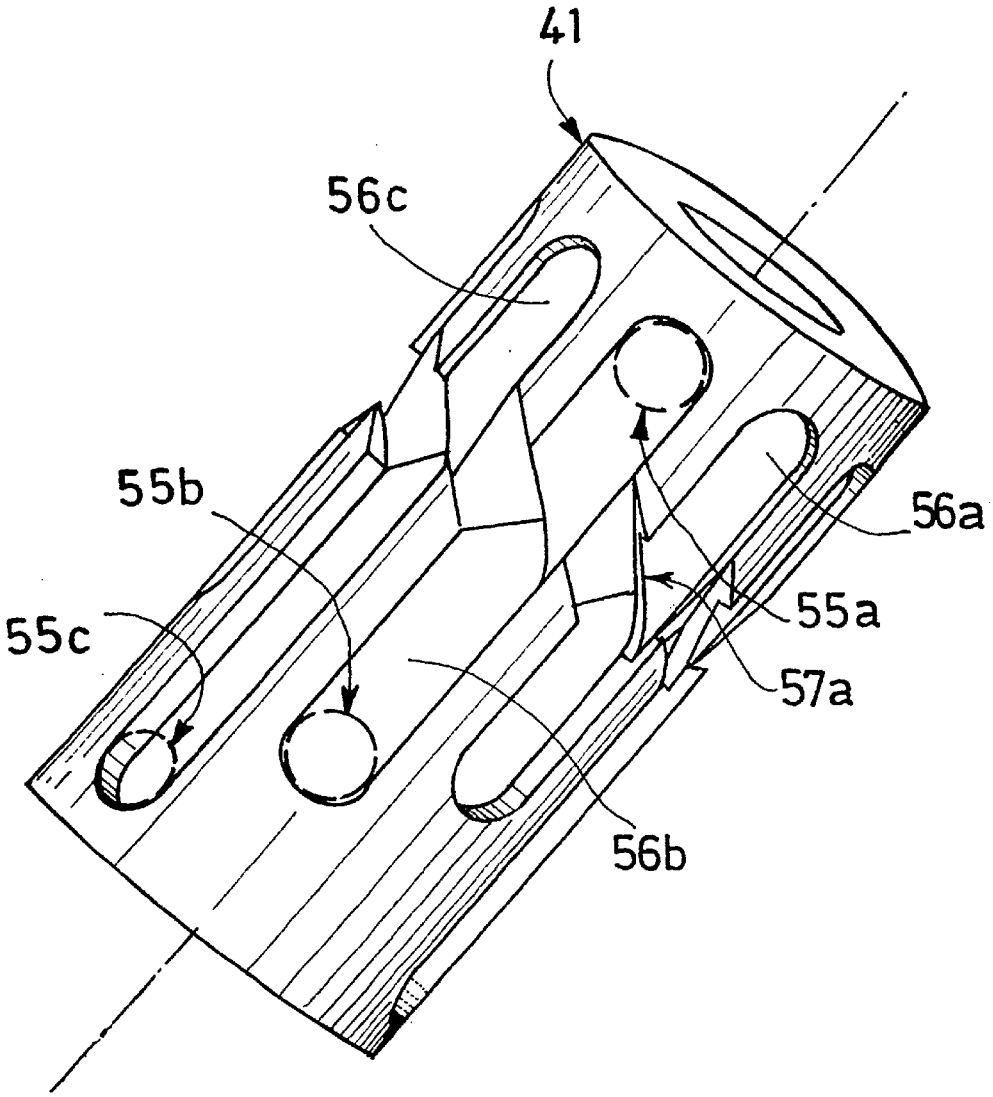

FIGS. 9*a* and 9*b* are two schematic perspective views of the stabilizer, respectively in the engaged state and in the disengaged state;

FIG. 10 represents two partial longitudinal half sections of the stabilizer, showing the blade block mechanism and the engagement/disengagement system, respectively in the engaged position (upper half section) and in the disengaged position (lower half section);

FIG. 11 is a cross-sectional cut along line XI—XI of FIG. 10;

FIG. 12 is a schematic diagram of the indexing mechanism of the stabilizer's state (diameter and engagement/disengagement).

We see that, under the effect of gravity, the section of the string 1 between the stabilizers 2 and 3 bends downward, which produces a lever effect on the first stabilizer 2 and makes it possible to generate an upward directed force $F_1$ on the drill bit 4.

Figures 1A, 1B, 2A, 2B:
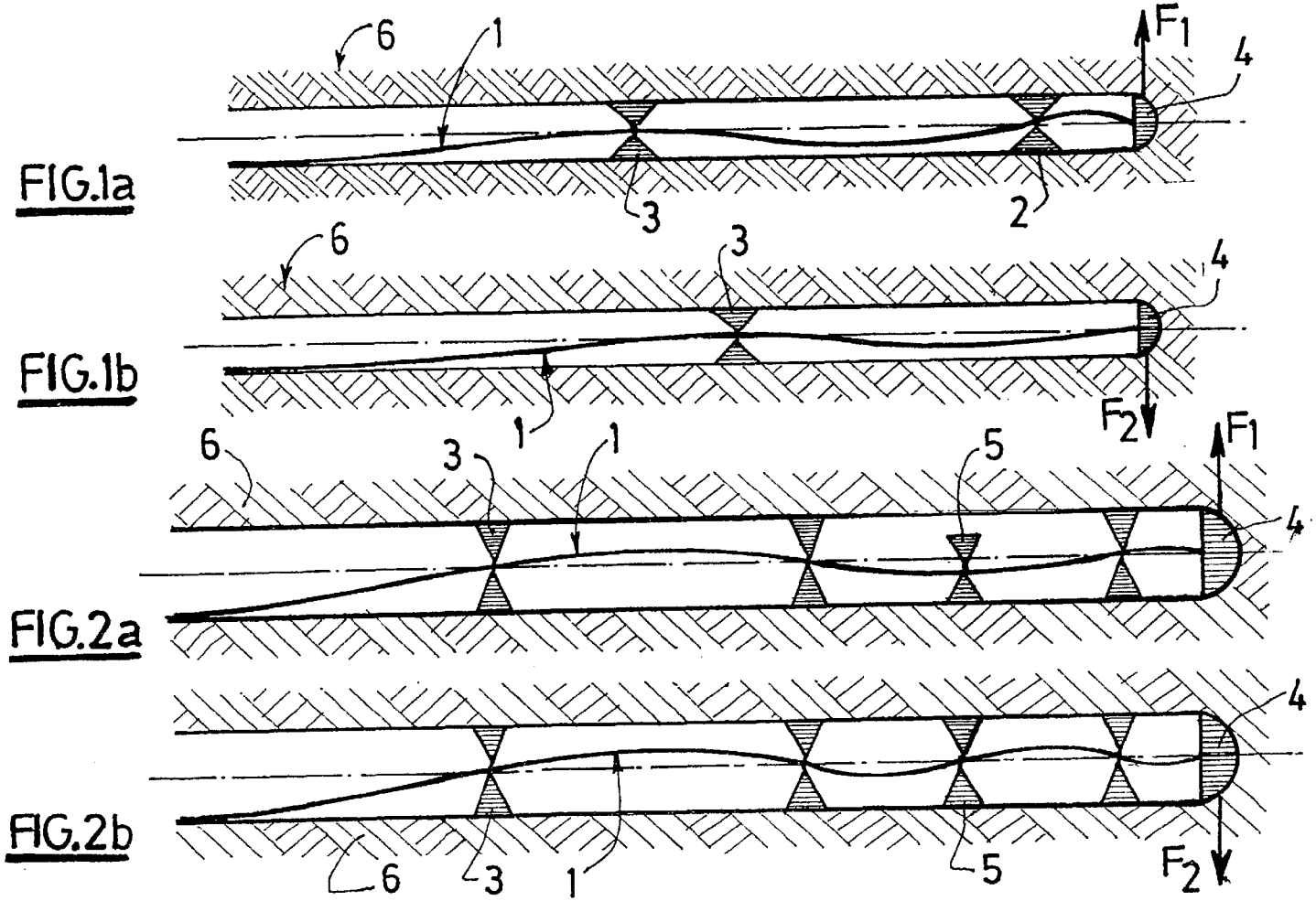

FIG. 1*b,* in which the elements already described are designated by the same reference numbers, illustrates a traditional configuration of a downward string. By eliminating the stabilizer 2 of FIG. 1*a* located close to the drill bit 4, the string unit 1 between the stabilizer 3 and the drill bit 4 produces, through a pendular effect, a force $F_2$ that is lateral to the drill bit and directed downward.

To make the most of the physical principle illustrated in said figures, to control the inclination, we have conceived stabilizers with variable diameters, that can usually accept various blade diameters (at least two extreme diameters, or three blade diameters, or more), their activation and their deactivation being carried out namely by acting of the weight exerted on the drill bit, or even on the injection pressure and the drilling fluid delivery.

By carefully choosing the two extreme diameters of a stabilizer with a variable diameter and playing with the configuration of the string (spacing and diameter of the stabilizers), we can obtain an upward string, for one of the stabilizer's extreme diameters and a downward string for the other extreme diameter.

This is illustrated in FIGS. 2*a* and 2*b,* where the stabilizer 5, in the second position from the drill bit 4, has two different diameters, where one is reduced (under-sized, called "undergauge", meaning with a diameter that is less that that of the drilled hole)—see FIG. 2*a*—corresponding to an upward string, and the other is larger (maximum, full hole, called "full-gauge", meaning with a diameter that is very close to that of the drilled hole)—see FIG. 2*b*—corresponding to a downward string. Between these two extremes, it is of course possible to chose an appropriate diameter that makes it possible to practically cancel the lateral force on the drill bit, thus making the drill string neutral in its inclination directional behavior, as was brought up earlier.

However, in the prior technique, the use of a stabilizer, with or without a variable geometry, was not taken into consideration to control of the azimuth direction of a rotary drilling system, meaning of the unit comprised of the string and the drill bit, where the term "variable geometry" can be taken in the strict sense of variable diameter or may include changes in shape, in contact surfaces, in the status of said contact surfaces or in distance between contact points.

This invention aims at providing the means for carrying out such a control, meaning exerting an action on the rotary drilling system that can generate a modification of the system's azimuth direction, for example a slow down of the system's tendency to drill to the right or to the left, or even a reversal of the drilling direction from the right to the left or vice versa.

With this end in view, the first object of the invention is a method for rotary well drilling, where said method is characterized by the following successive phases:

a drilling system comprised of an assembled drill bit with tubular string elements, means for measuring the inclination and azimuth direction of the pre drilled part of the well, means for friction against the wall of said pre-drilled part and controlled means capable of modifying the friction coefficient of said friction means against the wall are introduced into a pre drilled portion of the well;

the azimuth direction of the pre-drilled part of the well is measured;

and the friction coefficient of said friction means is varied sufficiently to influence the inclination and azimuth direction of the next well portion to be drilled.

Another object of the invention is a controlled rotary drilling string used to implement the above-mentioned method, where said string is comprised of a drill bit assembled with tubular string elements, means for measuring the inclination and azimuth direction of a pre-drilled part of the well in which it is meant to be engaged, and means of friction against the wall of said pre-drilled part, where this string is characterized in that it includes controlled means capable of modifying the friction coefficient of the friction means against the wall, in order to modify the lateral force transmitted by the string on the drill bit.

Advantageously, the means for friction include at least one stabilizing element with a variable geometry, in particular with a variable diameter, that guarantees the active control of inclination variations and whose blade block is free mounted in rotation in relation to the string and linked controlled means in rotation of the blade block of said stabilizer with the string, thus creating two possible modes of use: the disengaged mode (free blade block in rotation in relation to the string) and the engaged mode (linked blade block in rotation in relation to the string).

Said means of linking are preferably such that the stabilizing element can occupy two distinctive states, namely a first state, in which the friction coefficient is cancelled or reduced, that corresponds to the disengaged mode, and a second state, in which said coefficient is increased in relation to the previous state and that corresponds to the engaged mode.

Passing from one state to the next can be done by remote control from the ground surface, based on the measured position of the drill bit and the information concerning this position that is transmitted to the surface.

In the solution proposed herein, the variation of the friction coefficient of the means of friction is obtained by modifying the slide area: either located between the blade block and the wall of the well in the engaged mode, (strong friction coefficient), or located between the string and the blade block in the disengaged mode (low friction coefficient, if not non existent). We must point out that said modification of the friction coefficient can be obtained by other means without changing of the slide area. We can, for example, modify the state of the blade surface (removal of small bumps, modification of the direction of the grooves . . . ) of a traditional stabilizer, which results in modifying the friction coefficient at the interface between the blades and the formation.

Note that in the technique we already know of stabilizers that are capable of turning freely in relation to the drill string (see U.S. Pat. No. 5,810,100 A; see also the stabilizer proposed under the name SR 2 S ("Stationary Rubber Sleeve") by the French company SMFI (Société de materiel de Forage International). We also know of rotating stabilizers that can be engaged and disengaged automatically (see U.S. Pat. No. 4,989,679 A), and stabilizers with a variable diameter (see U.S. Pat. No. 4,848,490 A) but to date there has been no suggestion of creating stabilizers that can be engaged and disengaged in a controlled manner and whose external diameter can be modified simultaneously, also in a controlled manner. Nor has anyone suggested the use of such stabilizers in a method for rotary well drilling, in order to adjust the inclination and the azimuth of said well.

The invention will be described here after in more detail in reference to FIGS. 3*a* through 12 in the attached drawings.

As outlined above, the work carried out by the applicants concerning the directional behavior of drilling systems has made it possible to point out the impact of a certain number of parameters on the azimuth response of the drilling system. Said parameters are mainly:

- the friction coefficient between the stabilizer blades and the wall of the well,
- the drill bit.

Figure 3A:
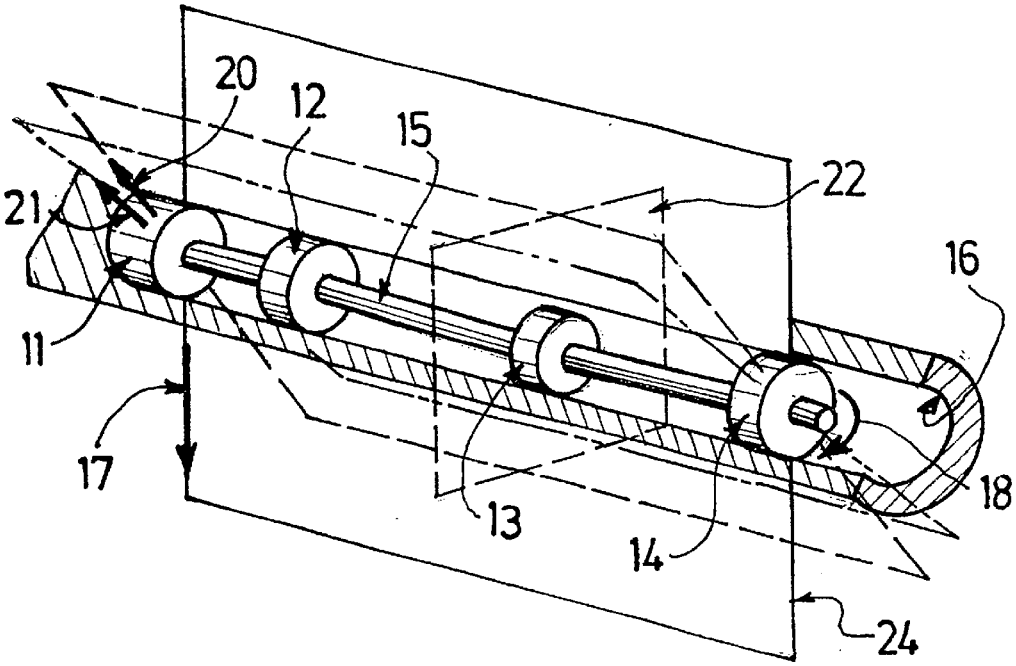

FIG. 3*a* shows a drill string that consists of assembled drill collars 15 and comprises a drill bit 11, two full hole stabilizers, one 12, known as the "near bit", meaning close to the bit, and the other 14, known as the "string stabilizer", meaning stabilizer fitted into the string, where this term designates any stabilizer except the one that is close to the bit, and lastly an under-sized stabilizer 13, meaning whose diameter is less than that of the hole. Once introduced into an inclined well 16 and under the effect of gravity 17, the drill collars between the stabilizers 12 and 14 bend and the stabilizer 13 comes in contact with the lower part of the hole.

Figure 3B:
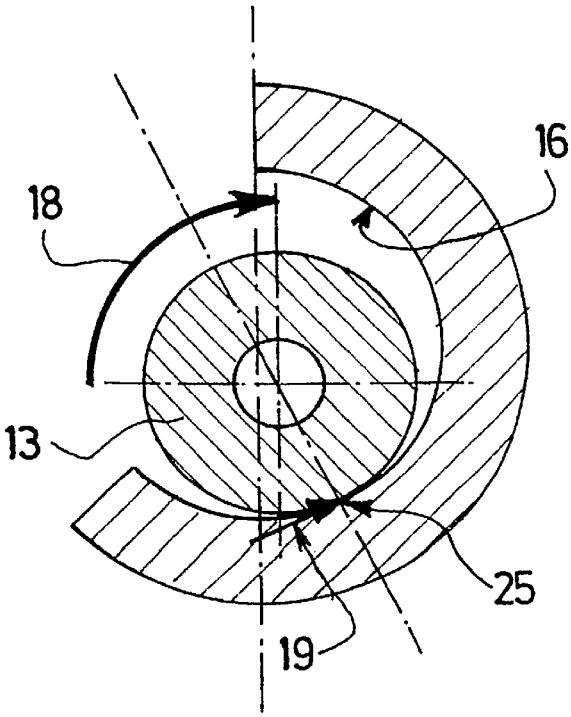

FIG. 3*b* is a sectional view of the transversal plane 22, at the level of the stabilizer 13. Under the combined effect of the rotation 18 and the friction coefficient between the blades of the stabilizer 13 and the wall of the well 16, the stabilizer 13 is subjected to a shear force 19, that tends to move the point of contact 25 on the wall of the well upward and thus makes it possible to make the lateral force 20 applied by the string 15 on the drill bit turn to the left in relation to the vertical plane 24. Therefore, the string 15 has a tendency to slightly push the drill bit to the left.

By playing with its geometry, it is possible to create a drill bit whose lateral movement 21 will be to the left (the case in FIG. 3*a*), parallel, or to the right, in relation to the direction of the lateral force 20 applied by the string.

In summary, the azimuth directional behavior of a drilling system or its capability to drill in a direction outside the vertical plane thus depends on:

- the friction coefficient between the under-sized stabilizer's blades and the wall of the hole, which influences the direction of the lateral force that is transmitted by the string to the drill bit.
- the directional behavior of the drill bit that defines the orientation of the drilling direction from the direction of the force applied.

Figure 4A:
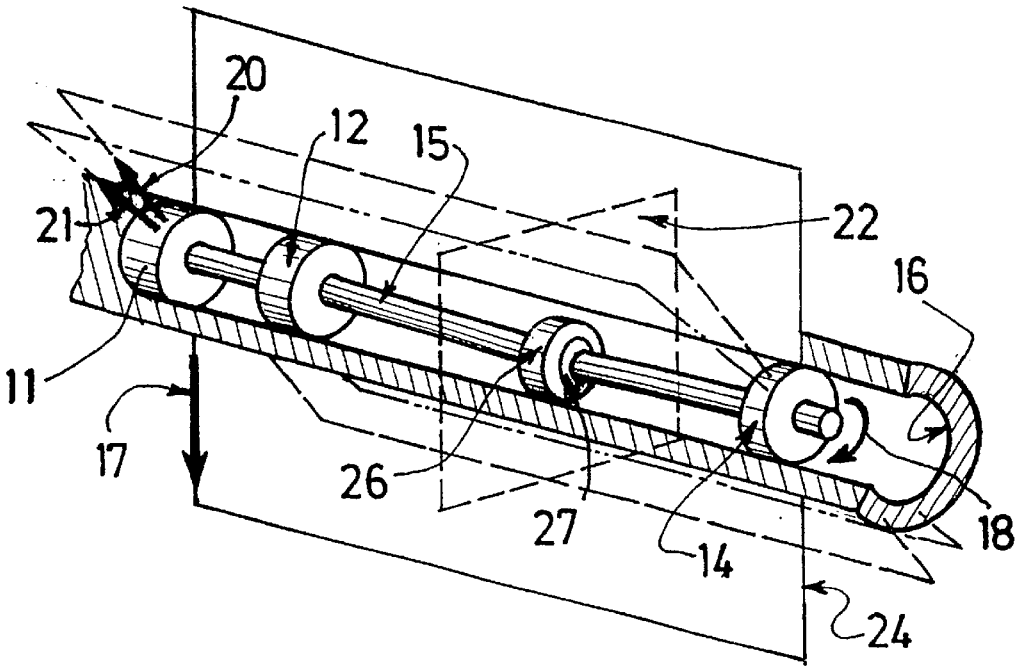

An example of implementation of this invention is shown in FIG. 4*a*.

The configuration of the string is that of FIG. 3*a,* and the elements already described in reference to said FIG. 3*a* are designated by the same reference numbers, but the stabilizer 13 has been replaced, in accordance with this invention, by a variable geometry stabilizer, comprising a blade block 26 and a stabilizer body 27. As indicated above, the term "variable geometry" can be taken in the strict sense of variable diameter or include changes in shape, in contact surfaces, in the state of said contact surfaces or in the distance between the contact points. In this FIG. 4*a* the blade block 26 is represented in the engaged mode, meaning integral with the body of the stabilizer 27.

Figure 4B:
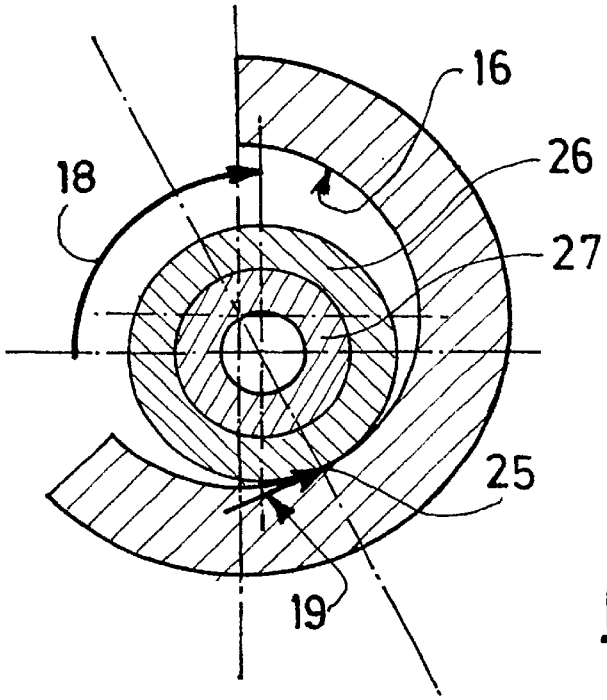

FIG. 4*b* is a sectional view of the transversal plane 22, where it is shown that the friction occurs at the interface between the blade block 26 and the rock 16, where the unit behaves like a traditional stabilizer.

Figure 5A:
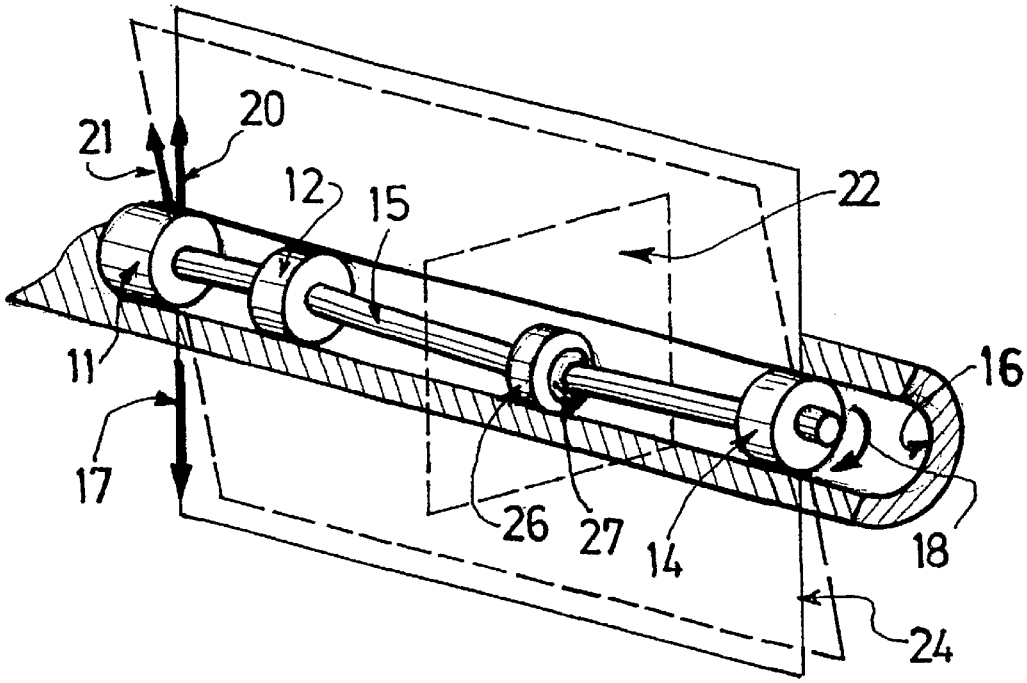

In the disengaged mode of FIG. 5*a*, the blade block 26 is no longer integral with the body of the stabilizer 27 and the lateral force 20 transmitted by the string 15 to the stabilizer then finds itself in the vertical plane 24.

Figure 5B:
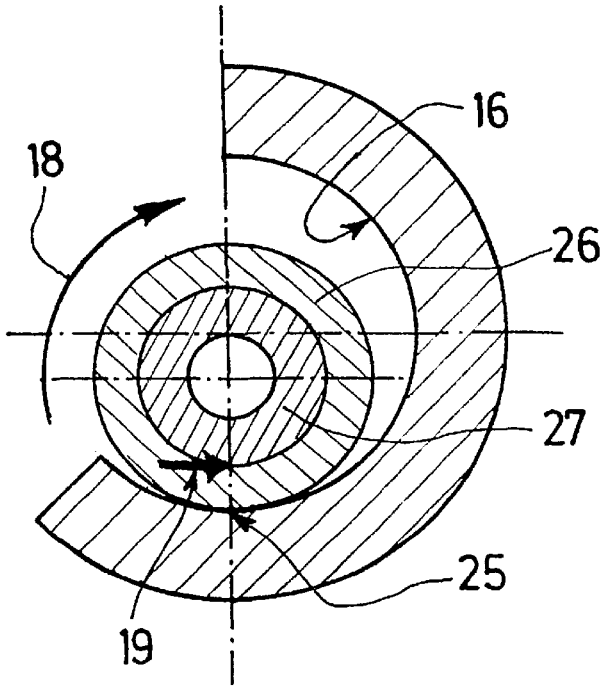

FIG. 5*b* is a sectional view of the plane 22 where it is shown that the friction occurs at the interface between the blade block 6 and the body of the stabilizer 27: as the friction coefficient is very low, the shear force 19 is almost non existent and the contact point 25 is located in the vertical plane.

We will note that, in order to have a positive azimuth gradient in one of the stabilizer's modes of use, and a negative gradient in the other mode, we can intervene on the following parameters:

- the number, the diameter and the position of the stabilizers,
- the position, the diameter and the friction coefficient of the blade block on the drilled formation, in the engaged mode,
- the directional characteristics of the drill bit.

Figure 6:
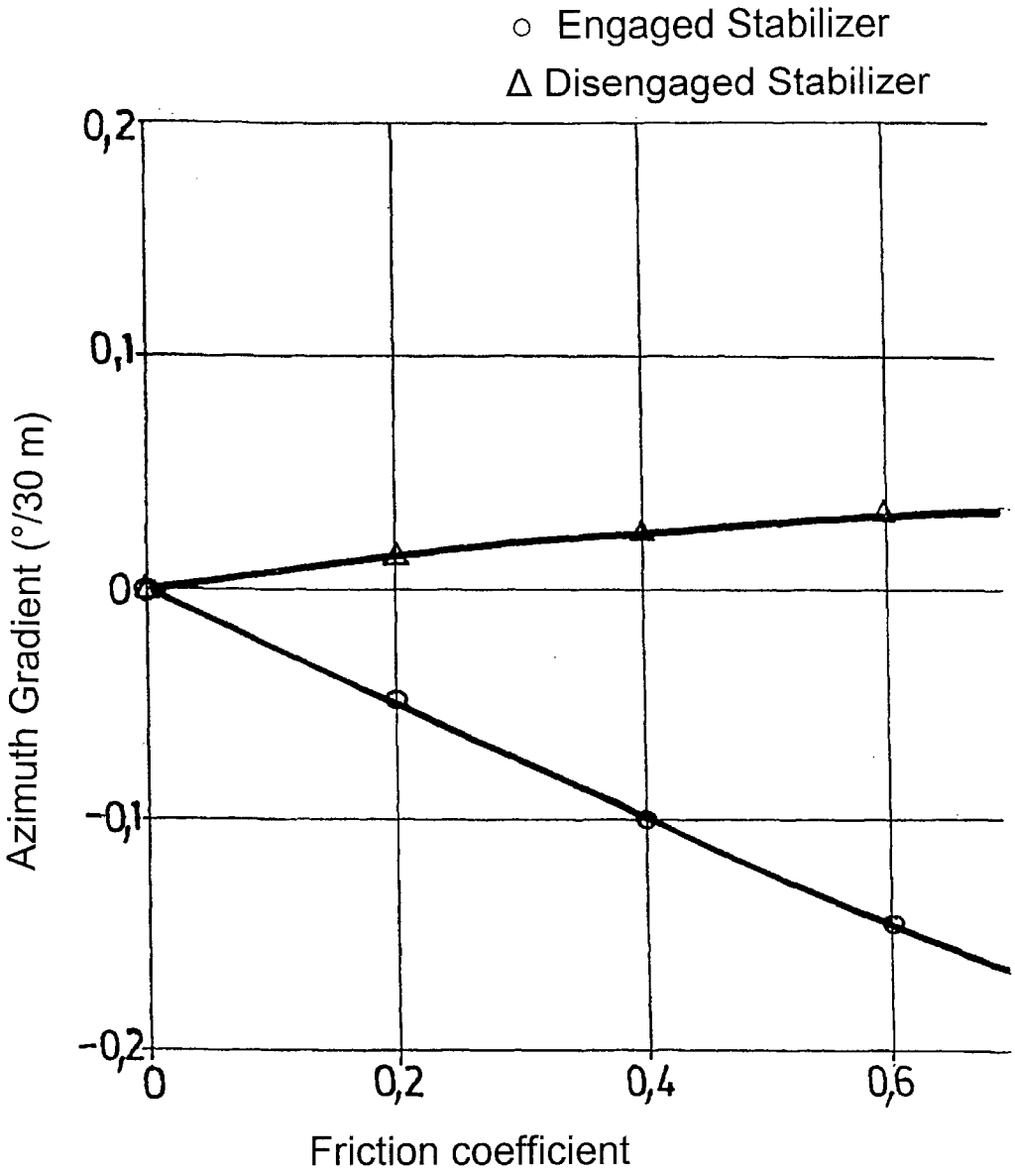
FIGS. 6 and 7 are graphs that offer the azimuth and inclination gradient for the two modes, engaged and disengaged, based on the friction coefficient between the stabilizer as set forth in the invention and the formation in which the well is drilled.

FIG. 6 shows the evolution of the azimuth gradient (in degrees/30 meters) based on the blade block/formation friction coefficient for an upward string comprised of four stabilizers.

Note that in passing for example from a friction coefficient of 0.4, which corresponds to the engaged mode of the stabilizer, to an artificially nil friction coefficient, which corresponds to the disengaged mode, the azimuth gradient the goes from 0.1 degree/30 m (to the left) to +0.02 degree/30 m (to the right). These values can be increased by adjusting the configuration and the type of drill bit.

Figure 7:
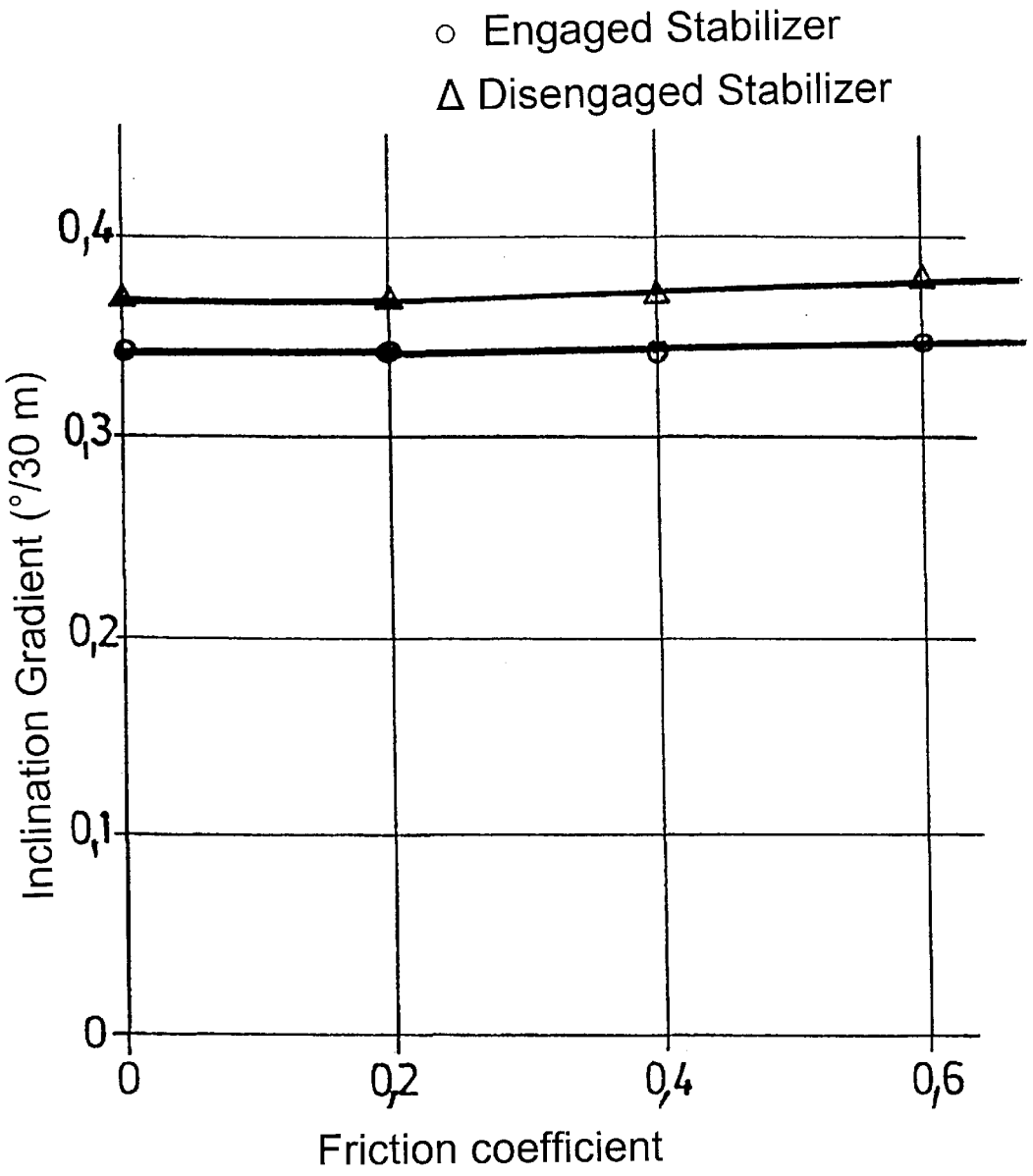

FIG. 7 illustrates the evolution of the inclination gradient based on the blade block/formation friction coefficient for the same upward string comprised of four stabilizers.

We note that the inclination gradient is more or less independent from the friction coefficient, which demonstrates that the control of the azimuth directional system, using the invention, remains almost independent of the inclination behavior.

Figure 8:
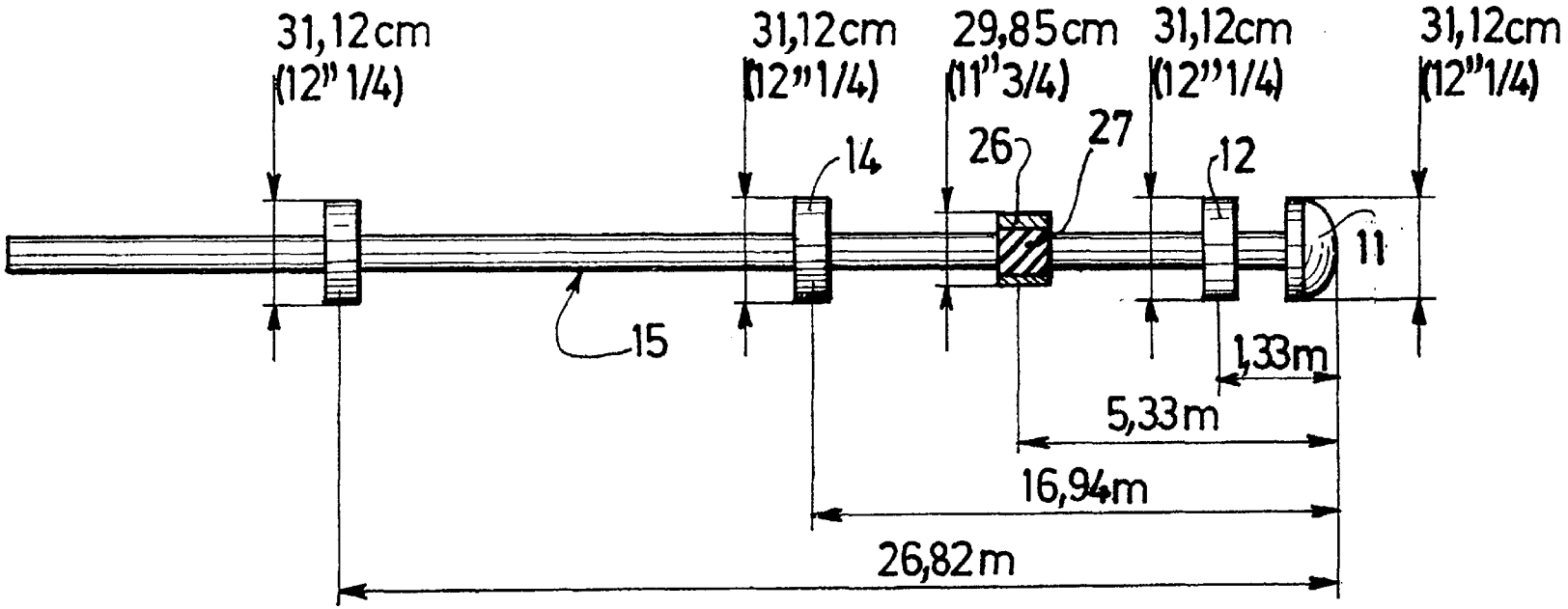
FIG. 8 is a view that illustrates the traditional measurements in the example of a string as set forth in the invention.

The dimensional characteristics in an example of upward string as set forth in the invention appear in FIG. 8, where the elements already described in reference to FIGS. 4*a,* 4*b,* 5*a* and 5*b* are designated by the same reference numbers.

The diameters of the various elements are not only expressed in centimeters but, as is customary in the oil industry, also in inches (one inch is equal to 2.54 cm).

One method of execution of a stabilizer with a controlled engagement and disengagement is with a variable diameter that is also controlled, capable of being used in the context of the invention, will now be described in reference to FIGS. 9*a*–9*b* through 12 of the attached drawings.

The unit schematically represented in FIGS. 9*a* and 9*b* is essentially composed of two parts, one high part 30, for which we will simply mention the functions, and one low part 31 that will be described here after in more detail and is connected to part 30 by an intermediary joint 32.

Part 30 comprises:

- a part 33, whose function is to guarantee a hydraulic visualization system that makes it possible to confirm the state of the bit (diameter and engagement);
- a part 34, that comprises one or several return elements meant to apply a distinctive prestressing on the described system to guarantee cohesion between its mobile parts in any position;

a part 35, that guarantees the controlled transmission of the drilling torque between the string linked to the surface and the string arranged below the system to the drill bit. Furthermore, this part 35 guarantees the transmission of the weight on the drill bit through straight and variable stops.

The intermediary joint 32 guarantees cohesion between the high part 30 and the low part 31.

According to one main characteristic of the invention, the bit is telescopic. It is represented in FIG. 9*a* with the male engagement connection 36 engaged and, in FIG. 9*b,* with said male connection 36 disengaged.

The rotating blade block 37 comprises blades 45, here in the number of three, whose variable diameter is adjustable in a way that will be described in further detail here after. The lower part of the blade block 37 comprises a female part that cooperates in a controlled way with the male connection 36, through a system of grooves.

In the example shown, the engagement system bathes in the drilling fluid, which simplifies its execution, but it could just as well be equipped with sealing systems and then be positioned in a hydraulic fluid.

The bit is meant to occupy a position within the bottom assembly of the string (called Bottom Hole Assembly or BHA) that allows it to ensure inclination and azimuth control under the best possible conditions of efficiency.

In FIGS. 10 and 11, where only part 31 of the bit is represented, the stabilizing function with variable geometry and the engagement-disengagement function that are at the heart of the invention are brought together. This example of execution comprises a main multifunction shaft 41, a sleeve 42 that is concentric to it and carries the blade block 37, and an intermediary connection 44.

The rotating blade block 37 occupies a central part of part 31 and is comprised of three blades 45, held by their extremities in a blade carrying sleeve 6 by return springs 47. The blades 45 act as shoes and are in controlled contact with the wall of the well, to ensure the centering or decentering of the unit and the string elements above and below that are integral with it. It is thus possible, as stated above, to act on the deflection of the solid elements of the string under the influence of gravity, in order to apply a desired module and direction force to the drill bit.

The blades 45 rest on actuators 48 that slide in recesses 49 and are meant to pick up a significant fraction of the forces exerted on the blades. The latter are held in permanent contact with the actuators 48 by end return springs 47.

The actuators 48, in this case cylindrical, are comprised at their lower part of a ball system 50, aimed namely at ensuring that the rotary blade block rolls on tracks when the bit is in the disengaged position. Said tracks are arranged at the external surface of a part 51, creating a back and forth liner that makes it possible to index the external diameter of the blades.

This part 51, concentric to the sleeve 42, is connected in its longitudinal movements to the shaft 41. It is mounted in a sliding manner on the sleeve 42 and comprises at its external surface degrees in steps, allowing it, when solicited by the shaft 41, to control the position of the blades 45 through actuators and make their external diameter vary.

Part 51 also comprises depressions 52, that constitute, in certain positions of the shaft 41, tracks for the balls 50 of the actuators 48.

The blade block 37 is guided along the sleeve 42 by ball bearings 53 meant to allow it to rotate as freely as possible.

In the type of execution represented in the drawings, the function of variation of the diameter of the blades and the engagement-disengagement function of the blade block 37 that will be described here after are controlled simultaneously by the multi-function shaft 41 according to a predetermined automatic sequence but theses two functions could be dissociated without leaving the realm of the invention.

As stated previously, the unit described is telescopic in itself. In a stable state, it can therefore either be popped-in, meaning occupy a shortened position, in particular when the drill bit rests on the bottom of the well, or occupy an extended position, when the drill bit is no longer resting on the bottom of the well. The invention takes advantage from the passing from a first stable state to a second stable state to ensure, in a way that is automatic and in this case simultaneous, the function of diameter change and the engagement-disengagement function.

With this end in view, an indexing element 54 is comprised of fingers 55 attached to the extremity of the upper part of the sleeve 42 and mounted on springs. Said fingers cooperate with ramps, machined into the shaft 41, where said unit, when passing from one stable state to another, ensures controlled and predetermined movements of the shaft and therefore of to the back and forth sleeve connected to it.

In the example illustrated in FIG. 12, the ramps are composed of straight parts 56*a,* 56*b,* 56*c,* etc., parallel to the axis of the shaft 41 and whose high and low parts correspond to the above-mentioned stable states (meaning to the positions of the drill bit at the bottom of the well and above the bottom of the well respectively) and parts such as 57*a* arranged sideways in relation to the previous parts, which they bring together and that ensure a cycle change under the effect of a rotation of the shaft 41 controlled by the indexing fingers 55.

We will note that the shape of the ramps is such that it prohibits the fingers 55 from coming back to a previous position between two stable states, thus ensuring a continuous and cyclical series of rotations of the shaft 41 in a same direction.

In FIG. 12, in the case of the straight part 56*b,* one indexing finger is represented by an interrupted line in two stable states, referenced as 55*a* and 55*b,* where the 55*a* state corresponds to the system's extended position, with the drill bit above the bottom of the well, whereas the 55*b* state corresponds to the system's popped-in position, with the drill bit resting on the bottom of the well. In the stable state 55*a,* the system is in the extended position, systematically disengaged, where the bit is in what could be considered to be in a resting state, whereas, in the stable state 55*b* the system is in the popped-in position, which can be considered to be a working state and does not in any way anticipate the state of the diameter of the blades and the state of the engagement-disengagement function that will be set by design. In the case of the straight part 56*c* contiguous to part 56*b,* the stable state of the indexing finger symbolized in 55*c* corresponds, as does the stable state 55*b,* to an engaged state as it corresponds to the maximum range of telescoping.

Between the positions of the drill bit corresponding to the stable states 55*a* and 55*b,* the indexing finger 55 that remains in contact with the bottom of the ramp under the solicitation of its return spring, must pass a difference in level that appears clearly on the slanting part 57*a* and acts as a anti-return.

The indexing finger 55 passing from one straight part of a ramp to the straight part of the contiguous ramp causes, in addition to the straight movement of this shaft, a rotation of the latter. The straight parts have different lengths, which allows for relative positions of the shaft that correspond to any desired combination of shaft diameter and engagement and disengagement.

In the configuration represented on the upper half section of FIG. 10, the stabilizer is in the engaged position in its maximum popped-in state, which corresponds to the straight part 56*c* of a ramp and the position 55*c* of the indexing finger, allowing for maximum interpenetration of the engagement male connection and female connection. This position also corresponds to a determined diameter of the bit.

We will note that, for some bottom assembly configurations, the smaller the diameter of the blades of a traditional stabilizer (engaged), the greater the capacity to induce an azimuth gradient. With the stabilizer as set forth in the invention we will thus seek, through design, to associate the smallest diameter of the blades to the system's engaged position.

It is known, where the control of the inclination of a well is concerned, that for a specific configuration of the bottom assembly (bottom assembly with four stabilizers for drilling of straight parts of wells, meaning parts with a constant inclination), in which the stabilizer as set forth in the invention occupies the position of "active" stabilizer (second stabilizer from the drill bit), the bottom assembly takes on a directional behavior called "falling", meaning inducing a negative inclination gradient, for the maximum diameter of the blades (diameter called "full hole" in the technique). Conversely, for the minimum diameter of the blades, the bottom assembly takes on a directional behavior called "rising", meaning inducing a positive inclination gradient. Therefore, it is possible, to determine an intermediary diameter for which the bottom assembly induces a neutral behavior, meaning with a more or less non existent inclination gradient.

By combining these different parameters in an appropriate fashion, it is therefore possible to adapt the stabilizer as set forth in the invention to all practical conditions encountered in directional drilling.

What is claimed is:

1. A rotary well drilling method, comprising the following successive phases:

introducing into a pre-drilled part of a well (16) a drilling system comprised of a drill bit (11) assembled with tubular string elements (15), means for measuring the inclination and azimuth direction of the pre-drilled part of the well, means for rotary friction (26, 27) against the wall of said pre-drilled part and controlled means capable of modifying the friction coefficient of said means for friction against the wall;

measuring the azimuth direction of the pre-drilled part of the well (16); and varying sufficiently the friction coefficient of said means for friction (26, 27) to influence the azimuth direction of the next part of the well to be drilled, wherein the means for rotary friction comprise a stabilizing element with a variable geometry (26, 27), free-mounted in rotation in relation to the string (15), and controlled connection means in rotation of said stabilizing element with the string (15).

2. Method as set forth in claim 1, further comprising measuring the inclination direction of the pre-drilled part of the well, wherein the stabilizing element with a variable geometry (26, 27) is a stabilizing element with a variable diameter, making it possible to modify the inclination of the next part of the well to be drilled.

3. Method as set forth in claim 1, wherein the means for rotary friction comprise a stabilizing element with a variable geometry (26, 27) capable of functioning according to two different modes, namely a first mode, in which the friction coefficient against the wall of the pre-drilled part of the well (16) is nil or reduced, and a second mode, in which the friction coefficient is increased in relation to that of the previously stated mode.

4. A rotary drill stringy for implementing the method as set forth in claim 1, comprising (i) a drill bit (11) assembled with tubular string elements (15), means for measuring the inclination and the azimuth direction of a pre-drilled part of the well (16) in which it is meant to be engaged, and means for rotary friction (26, 27) against the wall of said pre-drilled part, and (ii) controlled means capable of modifying the friction coefficient of the means for friction against said wall, in order to modify a lateral force transmitted by the rotary drill string, wherein the means for rotary friction comprise at least one stabilizing element with a variable geometry (26, 27), free-mounted in rotation in relation to string elements (15) and controlled connection means in rotation of said stabilizing element with string elements (15).

5. String as set forth in claim 4, wherein the stabilizing element with a variable geometry (26, 27) is a stabilizing element with a variable diameter.

6. String as set forth in claim 5, wherein the controlled connection means in rotation of the stabilizing element with the string and the means that control a change of diameter of the stabilizing element act in a coordinated manner.

7. String as set forth in claim 4, wherein the connection means are such that the stabilizing element (26, 27) can occupy two different modes, namely a first mode, in which the friction coefficient is cancelled or reduced, and a second mode in which said coefficient is increased compared to that of the first mode.

* * * * *